United States Patent [19]

Onhisi et al.

[11] Patent Number: 5,072,242

[45] Date of Patent: Dec. 10, 1991

[54] INK JET RECORDING APPARATUS UTILIZING ELECTROLYSIS TO EFFECTS INK DISCHARGE

[75] Inventors: Hiroshi Onhisi, Hirakata; Soichiro Mima; Yuji Takashima, both of Nishinomiya, all of Japan

[73] Assignee: Matsushita Electric Industrial Co., Ltd., Osaka, Japan

[21] Appl. No.: 581,754

[22] Filed: Sep. 13, 1990

[30] Foreign Application Priority Data

Sep. 18, 1989 [JP] Japan ..... 1-241251
Sep. 19, 1989 [JP] Japan ..... 1-243727

[51] Int. Cl.[5] ..... B41J 2/06
[52] U.S. Cl. ..... 346/140 R; 346/75
[58] Field of Search ..... 346/140 R, 76 L, 76 PH, 346/108, 140 R, 76 L, 75

[56] References Cited

U.S. PATENT DOCUMENTS 3,747,120 7/1973 Stemme ..... 346/75
4,291,316 9/1981 Kakeno et al. ..... 346/140 R
4,536,776 8/1985 Knirsch et al. ..... 346/140 R
4,575,737 3/1986 Vermot-Gaud et al. ..... 346/140 R

OTHER PUBLICATIONS

Webster's Ninth New Collegiate Dictionary, copyright 1990, Merriam-Webster Inc., p. 401.

*Primary Examiner*—Benjamin R. Fuller
*Assistant Examiner*—Victor DeVito
*Attorney, Agent, or Firm*—Wenderoth, Lind & Ponack

[57] ABSTRACT

An ink jet recording apparatus includes an inking medium containing a liquid electrolyte. A chamber is provided for accommodating the liquid inking medium and having a pair of electrodes disposed therein. A signal generator is provided for applying to the pair of electrodes an electrolyzing signal for electrolyzing at least a portion of the electrolyte contained in the inking medium, and a subsequent discharge signal for effecting a discharge explosion of gases produced as a result of the electrolyzing signal. The inking medium is discharged from the chamber in response to the discharge explosion pressure resulting from the application of the electrolyzing and discharge signals.

11 Claims, 4 Drawing Sheets

INK JET RECORDING APPARATUS UTILIZING ELECTROLYSIS TO EFFECTS INK DISCHARGE

BACKGROUND OF THE INVENTION

1. Field of the Invention

The present invention generally relates to an ink jet recording apparatus and, more particularly, to an ink jet recording apparatus of a type utilizing a gas pressure developed as a result of electrolysis of a electrolyte or utilizing a shock wave resulting from an discharge explosion of g gaseous body developed as a result of the electrolysis.

2. Description of the Prior Art

An ink jet recording apparatus of the on-demand type capable of jetting a liquid inking medium under the influence of a pressure applied whenever the necessity arises as well known in the art, an example of which is shown in FIG. 6 as a schematic partial sectional representation. The illustrated prior art ink jet recording apparatus comprises an ink tank 102 accommodating therein a liquid inking medium 101, a displacement amplifying chamber 104 fluid-coupled with the ink tank 101 through a supply passage 103, a jetting nozzle 105 communicated with the displacement amplifying chamber 104, and a piezoelectric element 106 electrically connected to a high voltage generator 107. The high voltage generator 107 applies an electrical signal to the piezoelectric element 106 to cause the piezoelectric element 106 to deform mechanically in a direction inwardly and outwardly of the displacement amplifying chamber 104. When the piezoelectric element is deformed inwardly of the displacement amplifying chamber 104, the internal pressure of the displacement amplifying chamber 104 is increased with the liquid inking medium 101 consequently being expelled outwardly from the jetting nozzle 105 to form ink droplets 108 which successively travel towards an image receptor (not shown) such as, for example, a recording paper. This type of ink jet recording apparatus is disclosed in, for example, the Japanese Laid-open Patent Publication No. 48-9622, published in 1973.

It has, however, been found that the prior art ink jet recording apparatus of the type utilizing the piezoelectric element has the following problems. In the first place, the application of a high voltage of about two hundreds volts to the piezoelectric element results only in a mechanical deformation of the piezoelectric element within the range of several micrometers to several tens of micrometers and, therefore, a pressure chamber of an increased volume such as shown in FIG. 8 is necessitated to allow the displacement to be concentrated towards the nozzle. Accordingly, it has been difficult to construct a small-sized ink jet recording apparatus having a multi-nozzle system wherein a multiple of nozzles are disposed in an adjoining fashion. Also, since the piezoelectric element is expensive, it is also difficult to reduce the cost of a recording head.

Summarizing the foregoing, the prior art ink jet recording apparatus suffers drawbacks in that it is difficult to achieve a multi-nozzle system and a reduction in both the size and manufacturing cost of the ink recording apparatus.

SUMMARY OF THE INVENTION

The present invention has been devised with the foregoing taken into consideration and is intended to provide an improved ink jet recording apparatus of a type capable of easily accommodating the multi-nozzle system and also capable of being manufactured in a compact size and at a reduced cost.

In order to accomplish the above described object, the present invention provides an ink jet recording apparatus which includes an inking medium containing a liquid electrolyte. A chamber is provided for accommodating the liquid inking medium and having a pair of electrodes disposed therein. A signal generator is provided for applying to the pair of electrodes an electrolyzing signal for electrolyzing at least a portion of the electrolyte contained in the inking medium, and a subsequent discharge signal for effecting a discharge explosion of gases produced as a result of the electrolyzing signal. The inking medium is discharged from the chamber in response to the discharge explosion pressure resulting from the application of the electrolyzing and discharge signals.

With the foregoing construction, by the application of the signal from the signals generating means to the pair of the electrodes within the decomposing chamber, the liquid electrolyte contained in the liquid inking medium can be decomposed by the pair of the electrodes accompanied by the production of gaseous bodies. Forces resulting from the expansion in volume of the respective gaseous bodies and the shock waves resulting from a discharge explosion of the gaseous bodies developed as a result of the electrolysis, are utilized to expel the liquid inking medium outwardly from the decomposing chamber in the form of ink droplets which subsequently travel towards an image receptor sheet to accomplish a recording.

BRIEF DESCRIPTION OF THE DRAWINGS

This and other objects and feature of the present invention will become clear from the following description taken in conjunction with a preferred embodiment thereof with reference to the accompanying drawings, in which:

FIG. 3(*b*) is a chart showing the pattern of an output generated from the signal generator of FIG. 3(*a*);

FIG. 5(*b*) is a chart showing the pattern of an output generated from the signal generator of FIG. 5(*a*)

DETAILED DESCRIPTION OF THE EMBODIMENTS

Figure 1A:
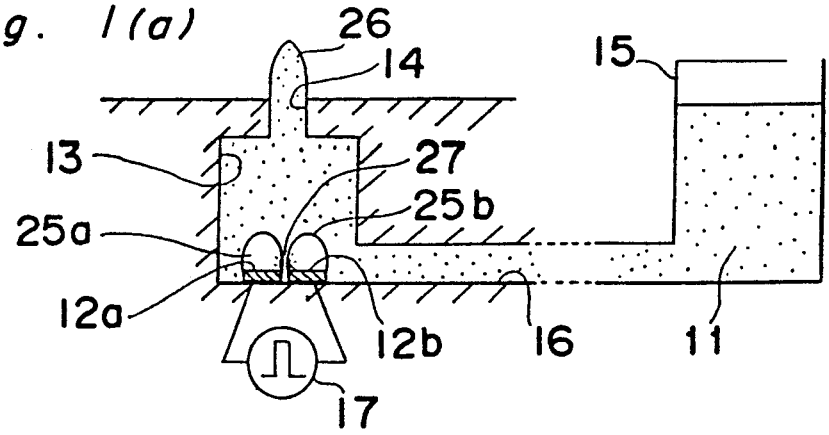
FIGS. 1(*a*) and 1(*b*) are schematic partial side sectional views of the ink jet recording apparatus according to a first preferred embodiment of the present invention, at different operative positions, respectively.
Figure 1B:
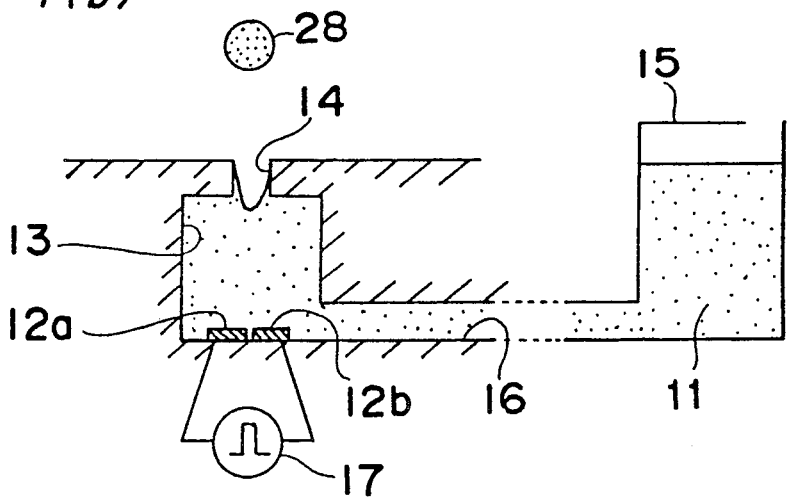

Referring first to FIGS. 1(*a*) and 1(*b*) there is shown an ink jet recording apparatus according to a first preferred embodiment of the present invention. As shown in FIG. 1(*a*), the ink jet recording apparatus comprises a liquid inking medium 11 containing an liquid electrolyte and a coloring agent, a pair of electrodes 12*a* and 12*b* used to electrolyze the liquid electrolyte contained in the inking medium 11, a decomposing chamber 13 capable of accommodating the inking medium 11 and having an interior wall to which the pair of the electrodes 12*a* and 12*b* are disposed, a nozzle 14 from which the inking medium 11 can be expelled outwardly in the form of successively travelling ink droplets, an ink tank 15 for the storage therein of the liquid inking medium 11, an ink supply passsage 16 through which the inking medium 11 within the ink tank 15 is supplied into the decomposing chamber 13 and then onto the nozzle 14, and a signal generator 17 for applying a signal voltage to the pair of electrodes 12*a* and 12*b*.

The signal generator 17 operates in response to an input signal applied thereto to apply to the pair of electrodes 12*a* and 12*b* an electrolyzing signal necessary to electrolyze the inking medium in the vicinity of the electrodes 12*a* and 12*b* and then a discharge signal necessary to effect a discharge explosion of gaseous bodies produced as a result of the electrolysis.

The recording with the ink jet recording apparatus of the above described construction takes place in the following manner.

A the outset, the inking medium 11 is supplied from the ink tank 15 into the decomposing chamber 13 and then into the nozzle 14 through the ink supply passage 16. Subsequent application of the electrolyzing signal from the signal generator 17 to the electrodes 12*a* and 12*b* results in electrolysis of that portion of the liquid electrolyte contained in the inking medium which is in contact with the electrodes 12*a* and 12*b*, producing gas bubbles 25*a* and 25*b*. By the effect of the gas bubbles 25*a* and 26*b* so produced, an ink meniscus 26 is formed at a discharge opening of the nozzle 14, as shown in FIG. 1(*a*), as a result of a volumetric expansion of the bubbles. At this time, the bubbles are mixed. Thereafter, by the application of the discharge signal from the signal generator 17, the gas bubbles 25*a* and 25*b* produced by the electrolyzing signal are caused to produce spark discharges 27, resulting in a generation of shock waves with which, as shown in FIG. 1(*b*), the inking medium 11 is expelled outwardly from the nozzle 14 while forming jetted ink droplets 28. Those ink droplets 28 are subsequently successively deposited on an image receptor (not shown) to accomplish the ink recording. Also, since the discharge explosion causes the gas bubbles 25*a* and 25*b* to be transformed into a solvent, almost no gas bubbles exist and the replenishment of the inking medium 11 through the ink supply passage 16 into the nozzle 14 and then into the chamber 13 permits the system to be restored to an initial condition. By repeating this cycle, the recording can continue.

Each of the electrodes 12*a* and 12*b* is made of material having a resistance to corrosion from the liquid electrolyte. For example, nickel, platinum, gold, silver or graphite may be chosen as the material for each electrode 12*a* and 12*b*. Also, the electrodes 12*a* and 12*b* may be made of a different material chosen from this group.

The liquid inking medium 11 contains the liquid electrolyte and the coloring agent. The coloring agent may be any dyestuff or pigments. The liquid inking medium 11 may contain one or more additives including a water-soluble resinous binder such as, for example, polyethylene glycol, polyvinyl alcohol or starch, and a surface active agent for assisting a dispersion of the dyestuffs or pigments and/or for assisting a surface tension.

The liquid electrolyte employable in the practice of the present invention is a liquid medium containing a solvent and an electrolyte dissolved in the solvent with at least a portion thereof ionized. Examples of the solute include, for example, sodium hydroxide, potassium hydroxide, sulfuric acid and sodium chloride, whereas examples of the solvent include, for example, water and alcohols. The inking medium 11 may also contain any liquid medium other than the solvent, for example, acetone or methyl ethyl ketone.

Also, the inking medium 11 may be in the form of an emulsion of a kind wherein oily droplets containing the coloring agent and the binder are dispersed in the liquid electrolyte.

The inking medium 11 is of a composition wherein the above described various compositions are preferably so combined that, during the electrolysis using the electrodes 12*a* and 12*b*, gases can be produced from the electrodes 12*a* and 12*b* to avoid any possible formation of deposits on the surface of each of the electrolytes 12*a* and 12*b*.

The material for the walls defining each of the nozzle 14, the ink supply passage 16 and the ink tank 15 should be of a type resistant to the attack from the inking medium 11 and includes, for example, ceramics such as, for example, quarts glass and alumina; metals such as, for example, brass and aluminum; curable resins such as, for example, epoxy resin; and thermoplastic resin such as, for example, acryl resin.

The material for the walls defining the decomposing chamber 13 in which the electrodes 12*a* and 12*b* are disposed is one of the materials for the nozzle 14 and at least an interior wall of the decomposing chamber 13 is made of insulating material such as quartz glass, silicon oxide or resin.

The ink jet recording apparatus according to the foregoing preferred embodiment of the present invention was assembled for experimental purposes in the following manner. A pair of electrode patterns (spaced 30 μm from each other) were formed of nickel on a quartz glass plate, followed by placement of a dry film resist (manufactured by I. E. du Pont de Nemours & Company and sold under a tradename "Solder Mask"), having a perforation of 100×100 μm in size and a rectangular opening (60 μm in width and 500 μm in length) defined therein in communication with said perforation, over the quartz glass plate so as to surround the nickel electrodes. The assembly was subsequently radiated with ultraviolet rays of light to accomplish a primary curing. A nickel foil of 20 μm in thickness having a perforation of 50 μm in diameter formed thereon by the use of an etching technique was applied to the quartz glass plate with the perforation positioned above a point intermediate between the nickel electrodes, followed by the heating of the assembly at 150° C. for 30 minutes to form both of the decomposing chamber 13 (100×100 μm in size and 20 μm in height) and the nozzle 14 (50 ∞m in diameter and 20 μm in length).

The inking medium 11 used was of a composition comprising 20 parts by weight of water, 5 parts by weight of sodium hydroxide, 5 parts by weight of isopropyl alcohol and 0.5 parts by weight of black dyestuffs (direct dyestuffs identified by "Kayaset Black 008(N)". The inking medium 11 could be supplied by the effect of capillarity from the rectangular opening in the dry film resist.

The application of the electrolyzing signal and the discharge signal from the signal generator 17 can result in an repetitive discharge of the inking medium at 50 Hz and with this repetitive discharge of the inking medium a black-and-white recording could be accomplished on a high quality paper.

When under the same condition the recording was interrupted during the application of the pulse width Pw by means of the signal from the signal generator 17, it was found that, while the bubbles ought to have been diminished upon cooling if only vapor existed, the bubbles 18*a* and 18*b* existed within the decomposing chamber 13 without being diminished. This evidences the presence of gaseous bodies, not vapor, generated as a result of electrolysis.

The electrolyzing signal may suffice to be of a voltage required to produce hydrogen and oxygen by means of an electrolysis of water, for example, 2 volts and, thus, the gaseous bodies can be produced with a relatively low voltage. At this time, since the gaseous bodies are produced immediately after movement of charges taking place on the surfaces of the electrode as a result of the application of the voltage, a response to the signal voltage is favorable. Also, since the shock waves produced as a result of the discharge explosion of the gaseous bodies produced as a result of the electrolysis by the discharge signal are utilized at this time, no displacement amplification such as required in the prior art recording apparatus is necessitated and a sufficient ink discharge force can be secured. In other words, the decomposing chamber may be sufficient to have the two electrodes disposed therein and the multiplication of the nozzles is possible while reducing in size and cost of the recording apparatus. Again, no electrolysis is required to take place until the chamber 13 is completely filled with the gaseous bodies, and a generation of a small quantity of gaseous bodies is sufficient, making it possible to reduce the cycle T of the signal as compared with that when only the electrolysis is used, thereby to accomplish a high speed recording.

The applied voltage required to accomplish the discharge explosion described above is low, for example, about 30 volts where the gaseous bodies so formed are spaced 10 μm from each other. Accordingly, where the electrodes are spaced a distance of 10 μm, the application of the voltage of about 30 volts to the liquid electrolyte can result in the formation of gases (hydrogen and oxygen) in the vicinity of each of the electrodes, which gases are subsequently mixed together to cover the spacing between the electrodes.

Preferably, the electrodes 12*a* and 12*b* are positioned close to each other with the distance therebetween so chosen as to be of a value sufficient to facilitate the discharge explosion.

Figure 4:
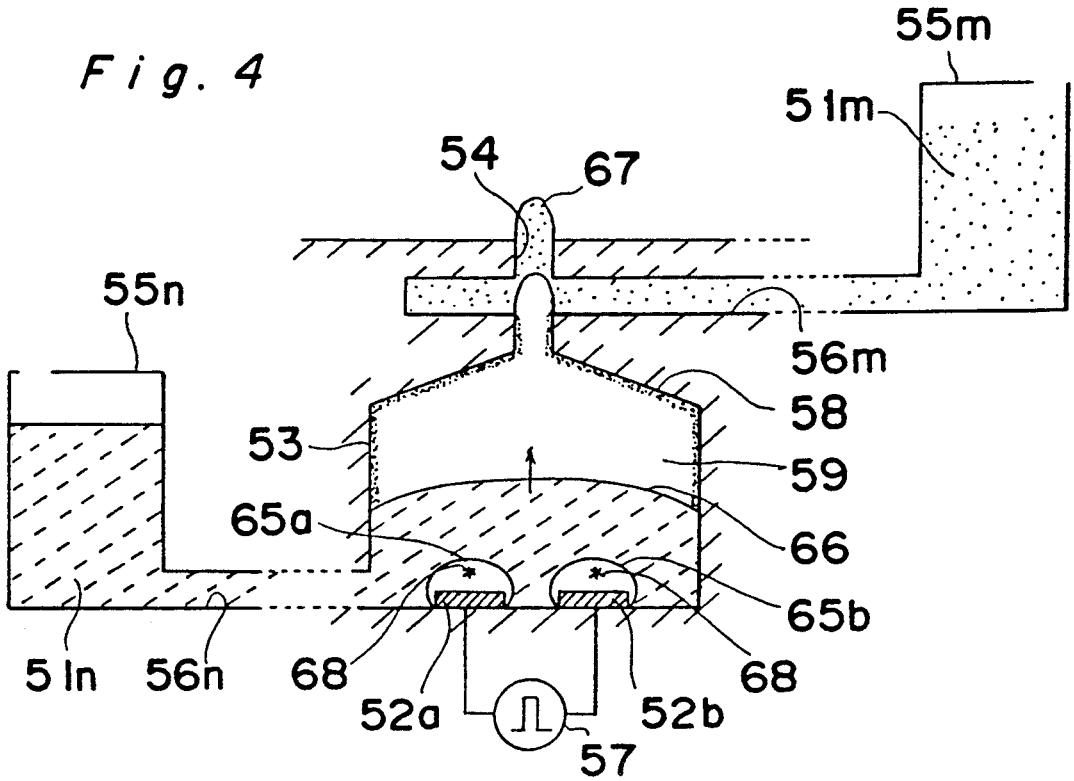
FIG. 4 is a schematic partial side sectional view of the ink jet recording apparatus according to a third preferred embodiment of the present invention.

The ink recording apparatus according to a second preferred embodiment of the present invention is shown in FIG. 4. Referring to FIG. 4, reference numeral 31 represents an inking medium containing an electrolyte and a coloring agent; reference numerals 32*a* and 32*b* represent a pair of electrodes, respectively; reference numeral 33 represents a decomposing chamber which can be filled up with the inking medium 31 and having an interior wall to which the electrodes 32*a* and 32*b* are attached; reference numeral 34 represents a nozzle from which the inking medium 31 can be expelled outwardly to the atmosphere; reference numeral 35 represents an ink tank accommodating the inking medium 31; reference numeral 36 represents an ink supply passage through which the inking medium within the ink tank 35 can be supplied to the decomposing chamber 33; and reference numeral 37 represents a signal generator for applying a signal voltage to the electrodes 32*a* and 32*b*. The recording apparatus shown therein also comprises a filtering membrane 38 disposed within the decomposing chamber 33 so as to divide the interior of the decomposing chamber 33 into a nozzle room and an electrolyte room, said filtering membrane 33 being of a type capable of passing only the electrolyte, contained in the inking medium 31, therethrough into the electrolyte room.

Figure 3A:
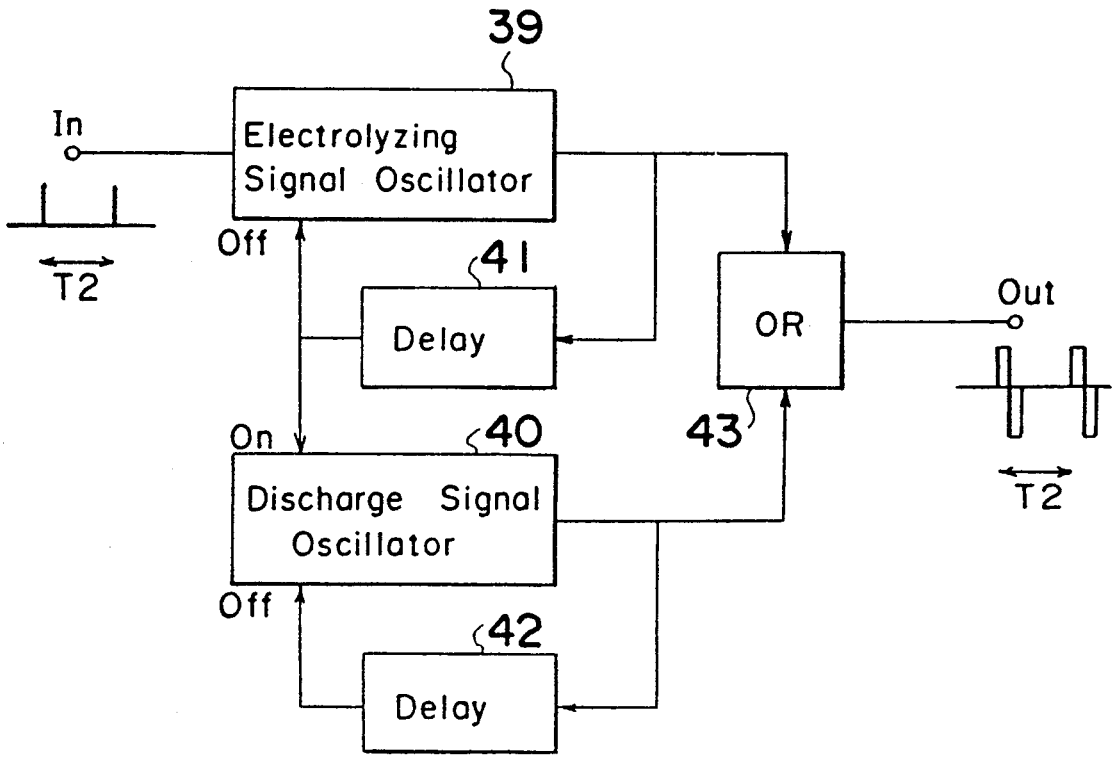
FIG. 3(*a*) is a block circuit diagram showing the signal generator employed in the practice of the second preferred embodiment of the present invention.
Figure 3B:
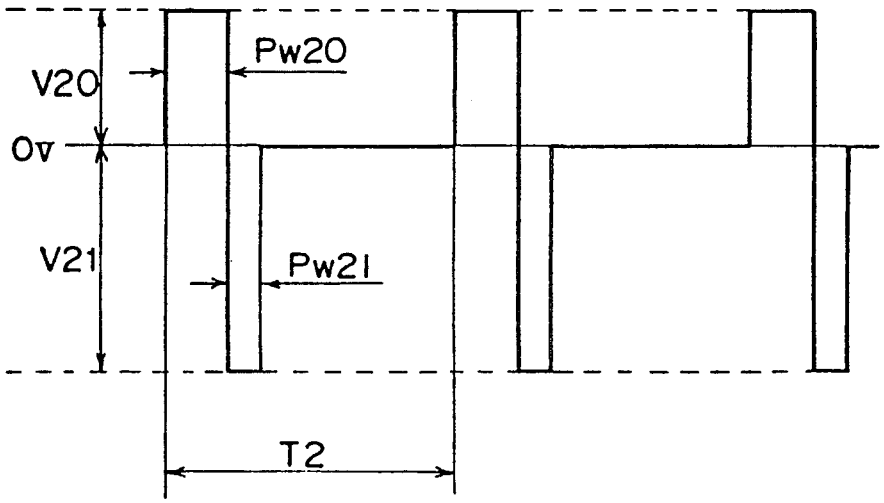

An essential portion of the signal generator 37 used in the practice of the second preferred embodiment of the present invention is shown in FIG. 3(*a*) in the form of a block circuit diagram, and the pattern of the output signal applied from the signal generator 37 to the electrodes 32*a* and 32*b* is shown in FIG. 3(*b*). As shown in FIG. 3, the signal generator 37 includes an electrolyzing signal oscillator 39 capable of outputting an electrolyzing signal voltage V20, when an On signal is inputted to the input terminal In, and also of zeroing the output voltage when an Off signal is inputted thereto; a discharge signal oscillator 40 capable of outputting a discharge signal voltage V21, higher than the electrolyzing signal voltage V20 and opposite in polarity to that of the electrolyzing signal voltage V20, when an On signal is inputted thereto, and also of zeroing the output voltage when an Off signal is inputted thereto; a first delay circuit 41 operable to delay the output of the electrolyzing signal oscillator 39 for a predetermined time Pw20 to provide the Off signal to the electrolyzing signal oscillator 39 and also to provide the input to the discharge signal oscillator 40; a second delay circuit 42 operable to delay the output of the discharge signal oscillator 40 for a predetermined time Pw21 to provide the Off signal to the discharge signal oscillator 40; and an OR circuit 43 capable of outputting a composite of respective outputs from the signal oscillators 39 and 40. The signal generator 37 shown in FIG. 3(*a*) can generate such a signal pattern as shown in FIG. 3(*b*) and applies, during each cycle T2, to the electrodes 32*a* and 32*b* the electrolysis signal voltage V20 having a pulse width Pw20 and, subsequently, the discharge signal voltage V21 of a polarity opposite to that of the electrolyzing signal voltage V20 and having a pulse width Pw21.

The recording with the use of the recording apparatus according to the second preferred embodiment of the present invention takes place in the following manner.

At the outset, the inking medium 31 is supplied from the ink tank 35 into the decomposing chamber 33 and then into the nozzle 34 through the ink supply passage 38. At this time, the electrolyte room of the decomposing chamber 33 is filled with a liquid medium 44 within the decomposing chamber 33, which medium 44 is mixed with at least the liquid electrolyte having passed through the filtering medium 38. Subsequently, the electrolyzing signal voltage V20 is applied at a pulse width Pw20 from the signal generator 37 to the electrodes 32*a* and 32*b* to cause the electrolyte, contained in the liquid medium 44 within the electrolyte room and contacting respective surfaces of the electrodes 32*a* and 32*b*, to undergo an electrolysis to thereby produce gas bubbles 45*a* and 45*b* on the respective surfaces of the electrodes 32*a* and 32*b* so that, by the effect of the volumetric expansion, the inking medium 34 can be discharged outwardly from the nozzle 34 to form an ink meniscus 46. Following the application of the electrolyzing signal voltage V20, the discharge signal voltage V21 opposite in polarity to that of the electrolyzing signal voltage V20, is applied to the same electrodes 32*a* and 32*b* and, therefore, a portion of the liquid electrolyte is further electrolyzed by the discharge signal voltage V21 wherefore mixed gases are developed within the respective gas bubbles 45*a* and 45*b* accompanied by a spark discharge 47 occurring in the vicinity of the respective electrode 32*a* and 32*b*. By the action of shock waves then produced, the inking medium 31 is expelled outwardly from the nozzle 34 in the form of an ink droplet (not shown). This ink droplet travels towards an image receptor (not shown) and subsequently deposits thereon to accomplish a recording. When and after the gas bubbles 45*a* and 45*b* having been exploded by the spark discharge 47 return to a solvent, both of the decomposing chamber 33 and the nozzle 34 are immediately replenished with the inking medium 31 then supplied from the ink tank 35 through the ink supply passage 36 to resume an initial condition, completing one cycle of jetting of an ink droplet. By repeating this cycle, the recording can be accomplished.

At this time, even though all of the gases may not be diminished as a result of the discharge explosion, the foregoing cycle can be repeated by discharging the remaining gases together with the inking medium 31.

The composition of the inking medium 31, the material for the walls defining each of the decomposing chamber 33, the nozzle 34, the ink supply passage 36 and the ink tank 35 may be identical to those described in connection with the first preferred embodiment of the present invention.

The filtering membrane 38 may be made of material of a kind capable of filtering at least the liquid electrolyte, contained in the inking medium 31, and the gases produced as a result of the electrolysis. For example, the filtering membrane 38 may be made of material of a microporous of mesh structure such as, for example, metal, ceramics or polymer, which is effective to remove particles contained in the inking medium 31.

If the inking medium 31 of a type in which pigments such as, for example, graphite or carbon, are dispersed in the liquid electrolyte, is used in combination with the filtering membrane 38 in the form of a microporous polymer membrane of about 10 μm in thickness, the pigments do not pass through the filtering membrane 38 and the electrolyte room of the decomposing chamber 33 can almost be filled up with the liquid electrolyte.

As is the case with the recording apparatus shown in and described with reference to FIG. 1, the recording apparatus according to the second preferred embodiment of the present invention makes use of the electrolysis and can be manufactured in a compact size at a reduced cost while accomplishing a high speed recording. In addition, the use of the filtering membrane 38 permits the electrolyte room of the decomposing chamber 33 to be filled with the liquid medium 44 within the decomposing chamber 33 containing the liquid electrolyte in a proportion higher than that in the inking medium 31, and therefore, the electrolysis will not be hampered which would otherwise occur in the presence of the coloring agent and the additives both contained in the inking medium 31 and separated by the filtering membrane 38, thereby accomplishing an efficient electrolysis.

Also, according to the second preferred embodiment of the present invention, since no solid particle other than the gases is formed on the respective surfaces of the electrodes 32*a* and 32*b*, the lifetime of the recording apparatus can be advantageously increased as compared with that according to the first preferred embodiment of the present invention.

Again, in the second preferred embodiment of the present invention, since the electrolyzing signal and the discharge signal are opposite in polarity to each other, the electrolysis occurs somewhat before the discharge when the discharge voltage is applied and, therefore, the gases produced in the vicinity of the electrodes 32*a* and 32*b* can be rendered to be mixed gases. Accordingly, the spacing between the electrodes 32*a* and 32*b* need not be narrowed and, therefore, the recording apparatus can be easily assembled.

Furthermore, according to the second preferred embodiment of the present invention, although reference has been made to the use of the electrolyzing voltage and the discharge voltage opposite in polarity to each other, the electrolyzing signal and the discharge signal which are the same in polarity may be applied between the electrodes in the case of the recording apparatus wherein the spacing between the electrodes is reduced such as shown in connection with the first preferred embodiment of the present invention.

It is to be noted that the recording apparatus according to the second preferred embodiment of the present invention can be used and operated in a manner wherein the gases developed as a result of the electrolysis are utilized to expel the inking medium outwardly from the nozzle. However, where the recording apparatus according to the second preferred embodiment is used and operated in this manner, a longer time is required to purge the gases filling up the nozzle 34 subsequent to the jetting of the inking medium 34 and then to fill the nozzle 34 with the inking medium 34, and therefore, the utilization of the discharge explosion is preferred in the recording apparatus according to the second preferred embodiment.

The ink jet recording apparatus according to the second preferred embodiment of the present invention was assembled for experimental purposes in the following manner. A pair of electrode patterns (spaced 50 μm from each other) were formed of nickel on a quartz glass plate, followed by attachment of a polycarbonate membrane (used as the filtering membrane 38 and manufactured and sold by Nomura Micro-Science under a tradename "Nuclepore Micromembrane") having a thickness of 10 μm, so as to surround the electrodes and then followed by the attachment of a dry film resist (manufactured and sold by I. E. du Pont de Nemours & Company under a tradename "Solder Mark"), having a perforation of 100×100 μm in size and a rectangular opening (60 μm in width and 500 μm in length) defined therein in communication with said perforation, over the quartz glass plate so as to cover the filtering membrane 38. The assembly was subsequently radiated with ultraviolet rays of light to accomplish a primary curing. A nickel foil of 20 μm in thickness having a throughhole of 50 μm in diameter formed therein by the use of an etching technique was applied to the quartz glass plate and, thereafter, the assembly was heated at 110° C. for 50 minutes to form both of the decomposing chamber 33, 100×100 μm in size and 20 μm in height, and the nozzle, 50 μm in diameter and 20 μm in length. Although at this time the surroundings of the electrodes were covered by the filtering membrane 38, the bonding takes place at the dry film and, therefore, no contact occurred substantially between the filtering membrane 38 and the electrodes. In other words, only the liquid medium having passed through the filtering membrane 38 can contact the electrodes 32*a* and 32*b*.

The inking medium 31 used was of a composition comprising 20 parts by weight of water, 5 parts by weight of sodium hydroxide, 5 parts by weight of isopropyl alcohol and 5 parts by weight of graphite. Thereafter, while the recording apparatus as a whole is reduced in pressure with the aid of an vacuum pump, the inking medium 31 was filled in the recording apparatus by connecting the inking medium 31 with an opening of the ink supply passage 36. When the signal generator 37 is driven by a pulse width (500 Hz, Pw20: 0.5 ms, P221: 0.1 ms), a black-and-white recording on a high quality paper could be achieved with the electrolyzing signal voltage V20 being 30 volts and with the discharge signal voltage V21 being 100 volts. Also, the application of the voltage could be minimized as compared with that in the previous embodiment and therefore a low energy consumption could be accomplished.

Figure 5A:
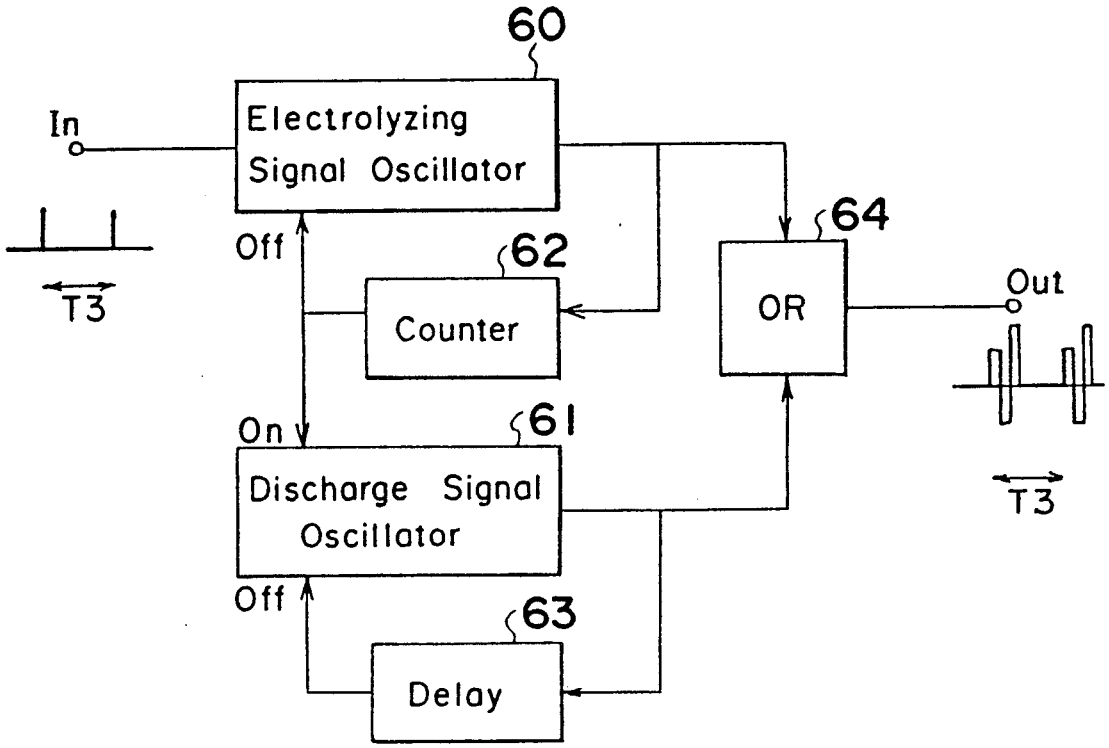
FIG. 5(*a*) is a block circuit diagram showing the signal generator employed in the practice of the third preferred embodiment of the present invention.
Figure 5B:
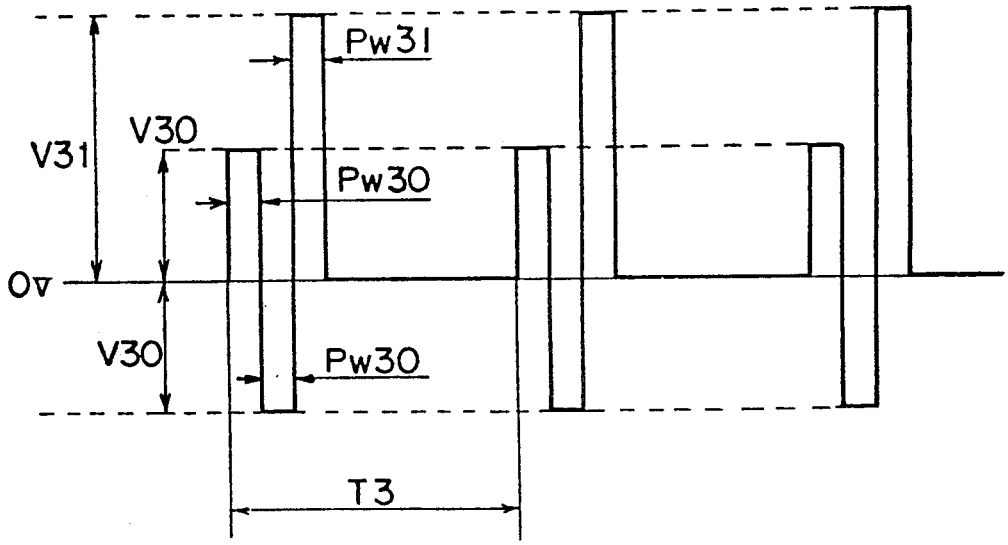

The ink jet recording apparatus according to a third preferred embodiment of the present invention is shown in FIGS. 4 and 5. Referring first to FIG. 4, reference numeral 51*m* represents an inking medium containing a coloring agent; reference numeral 51*n* represents a liquid electrolyte capable of being electrolyzed; reference numerals 52*a* and 52*b* represent a pair of electrodes operable to electrolyze the electrolyte 51*n;* reference numeral 53 represents a decomposing chamber capable of being filled with the inking medium 51 and having an interior wall to which the electrodes 52*a* and 52*b* are attached; reference numeral 54 represents a nozzle from which the inking medium 51 can be expelled outwardly to the atmosphere; reference numeral 55*m* represents an ink tank accommodating therein the inking medium 51*m;* reference numeral 55*n* represents an electrolyte tank accommodating therein the liquid electrolyte; reference numeral 56*m* represents an ink supply passage through which at least the nozzle 54 can be filled with the inking medium 51*m* from the ink tank 55*m;* reference numeral 56*n* represents an electrolyte supply passage through which the respective surfaces of at least the electrodes 52*a* and 52*b* can be supplemented with the electrolyte 51*n* from the electrolyte tank 55*n;* and reference numeral 57 represents a signal generator for applying a signal voltage to the electrodes 52*a* and 52*b*. According to the third preferred embodiment of the present invention, a portion of the wall defining the decomposing chamber 53 is employed in the form of a water-repellent wall 58 and a gaseous medium 59 is employed to separate the inking medium 51*m* and the electrolyte 51*n* from each other to thereby avoid any possible contact therebetween within the decomposing chamber 53.

An essential portion of the signal generator 57 used in the practice of the third preferred embodiment of the present invention is shown in FIG. 5(*a*) in the form of a block circuit diagram, and the pattern of the output signal applied from the signal generator 57 to the electrodes 52*a* and 52*b* is shown in FIG. 5(*b*). As shown in FIG. 5(*a*), the signal generator 57 includes an electrolyzing signal oscillator 60 capable of rendering an output voltage to the zero volts upon receipt of an Off signal after a voltage V30 and a voltage opposite in polarity to the voltage V30, each being of a pulse width Pw30 as shown in FIG. 5(*b*), have been outputted in response to the inputting of an On signal; a discharge signal oscillator 61 capable of rendering an output voltage to be zero upon receipt of an Off signal after a voltage V31 has been outputted in response to the inputting of an On signal; a counter 62 for providing the Off signal and the On signal to the electrolyzing signal oscillator 60 and the discharge signal oscillator 61, respectively, when the number of changes of the output voltage from the electrolyzing signal oscillator 60 counted thereby attains a predetermined number; a delay circuit 63 operable to delay the output of the discharge signal oscillator 61 for a predetermined time Pw31 to provide the Off signal to the discharge signal oscillator 61; and an OR circuit 64 capable of outputting a composite of respective outputs from the signal oscillators 60 and 61. The signal generator 57 shown in FIG. 5(*a*) can generate such a signal pattern as shown in FIG. 5(*b*) and applies, during each cycle T3, to the electrodes 52*a* and 52*b* the electrolysis signal voltage V30 of opposite polarities each having a pulse width Pw30 and, subsequently, the discharge signal voltage V31 having a pulse width Pw31.

The recording with the use of the recording apparatus according to the third preferred embodiment of the present invention takes place in the following manner.

At the outset, the inking medium 51*m* is filled in the nozzle 54 from the ink tank 55*m* through the ink supply passage 56*m* and, at the same time, at least the respective surfaces of the electrodes 52*a* and 52*b* are filled with the electrolyte 51*n*. At this time, the nozzle 54 need not be completely filled with the inking medium 51*m*. The signal voltage is subsequently applied from the signal generator 57 to the electrodes 52*a* and 52*b* to effect the electrolysis during which the electrolyte 51*n* contacting the electrodes 52*a* and 52*b* are electrolyzed to produce bubbles 65*a* and 65*b* on the respective surfaces of the electrodes 52*a* and 52*b*. By the effect of the volumetric expansion change from a liquid phase of the electrolyte 51*n* to a gas phase, the interface 66 of the electrolyte is convexed so as to protrude towards the nozzle 54 with an outwardly protruding ink meniscus 67 consequently formed in the nozzle 54. Then, since the electrolyzing signal voltage V30 applied comprises two voltage components of opposite polarities, a mixed gas exists within each of the bubbles 65*a* and 65*b*. Accordingly, the subsequent application of the discharge signal voltage V31 to the electrodes 52*a* and 52*b* results in a spark discharge 68 occurring in the vicinity of each of the electrodes 52*a* and 52*b*. By the action of shock waves produced at this time, the inking medium 51*m* can be discharged outwardly form the nozzle 54 and grows into an ink droplet (not shown) then travelling towards an image receptor. When this ink droplet is deposited on the image receptor (not shown), the recording can be accomplished. Thereafter, the inking medium 51*m* is supplied through the ink supply passage 56*m* towards the nozzle 54. Although the bubbles 65*a* and 65*b* when exploded as a result of the spark discharge 68, resume a liquid phase, a portion thereof is discharged to the outside together with the inking medium and, therefore, is consumed. To compensate for the consumption of the electrolyte, the electrolyte 51*n* is supplied through the electrolyte supply passage 56*n* to resume an initial condition, thereby completing each cycle. By repeating this cycle, the recording can be accomplished.

The material for the walls defining each of the decomposing chamber 53, the nozzle 54, the ink supply passage 56*m* and the ink tank 55*m* may be identical to, for example, that described in connection with the first preferred embodiment of the present invention.

The electrolyte supply passage 56*n* and the electrolyte tank 55*n* may be made of the same material as that used for, for example, the ink supply passage 56*m* and the ink tank 55*m*.

As discussed in connection with the principle of recording, the inking medium 51*m* utilizable in the practice of the present invention may be of a king capable of being electrolyzed, that is, containing no electrolyte, either water-based or oil-oil based.

The water-repellent wall 58 is formed of material of a type capable of repelling any one of the inking medium 51*m* and the liquid electrolyte 51*n*. By way of example, silicone or fluoroplastics may be employed for lining an interior wall of the decomposing chamber 53 to form the water-repellent wall 58.

Figure 2:
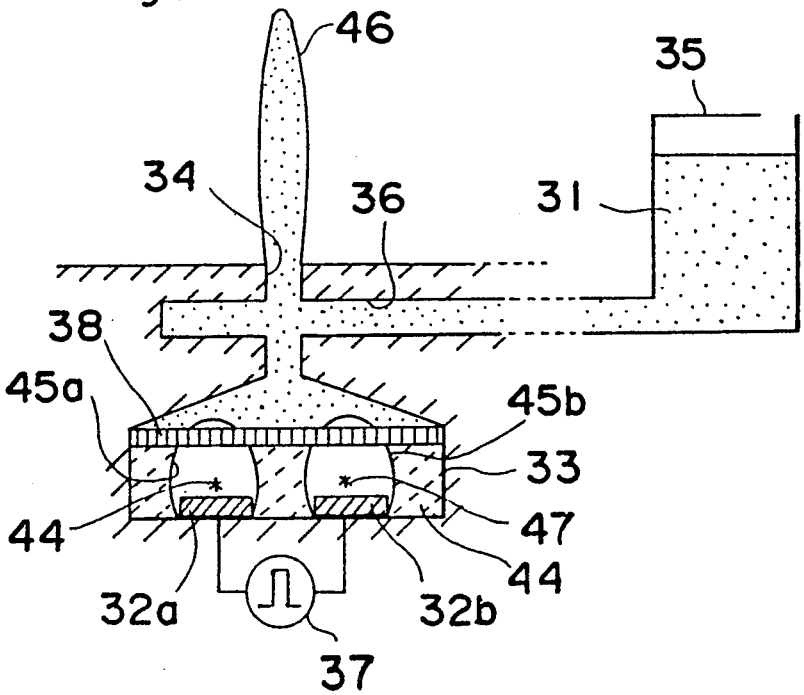
FIG. 2 is a schematic partial side sectional view of the ink jet recording apparatus according to a second preferred embodiment of the present invention.

As is the case with the recording apparatus shown in and described with reference to any one of FIG. 1 and FIG. 2, the recording apparatus according to the third preferred embodiment of the present invention makes use of the electrolysis and can be manufactured in a compact size at a reduced cost while accomplishing a high speed recording. The recording apparatus according to the third embodiment of the present invention furthermore has the following additional advantages. One of the additional advantages is that, since the inking medium 51*m* need not contain the electrolyte, the freedom of choice of inking medium is relatively large. Another one of the additional advantages is that, since only the liquid electrolyte 51*n* contacts the respective surfaces of the electrodes 52*a* and 52*b* and there is no impurity and nothing which would otherwise deposit on the surface of the electrodes, the electrolysis can take place efficiently with an increase in sensitivity.

It is to be noted that, according to the third preferred embodiment of the present invention, the inking medium 51*m* can be expelled by the sole action of the gases generated as a result of the electrolysis as is the case with that in the first preferred embodiment of the present invention. However, a longer time is required to purge the gases filling up the nozzle 54 subsequent to the jetting of the inking medium 51*m* and then to fill the nozzle 54 with the inking medium 51*m*, and therefore the utilization of the discharge explosion is preferred in the recording apparatus according to the third preferred embodiment.

The ink jet recording apparatus according to the third preferred embodiment of the present invention was assembled for experimental purposes in the following manner. After respective portions of a glass substrate which eventually form the electrolyte supply passage 56*n* and the decomposing chamber 53 have been etched to a glass substrate which eventually form the electrolyte supply passage 56*n* and the decomposing chamber 53 have been etched to represent recesses, a pair of electrode patterns (spaced 50 μm from each other) were formed in those recesses by vapor-depositing nickel with the use of an etching technique. Then, after grooves corresponding respectively to respective surfaces of the electrodes and the electrolyte supply passage 56 have been covered by polyethylene glycol (manufactured and sold by Dai-ichi Kogyo Seiyaku Co., Ltd. under a tradename "PEG #20000), the remaining recesses were applied with fluororesin (manufactured and sold by Sumitomo Chemical Co., Ltd. under a tradename "Sumiflunon FP91A) and were then dried. Thereafter, the PEG was flushed with water, followed by the placement of a dry film resist (manufactured and sold by I. E. du Pont de Nemours & Company under the tradename "Solder Mask") having a round through-hole of 80 μm in diameter and a rectangular opening (which eventually form the ink supply passage 56*m*) defined therein in communication with the round through-hole, which was subsequently radiated with the ultraviolet rays of light for a primary curing. A nickel foil of 20 μm in thickness having a through-hole of 50 μm in diameter and a rectangular opening communicated with the through hole, which were defined therein by the use of an etching technique, was then applied to the glass substrate and, thereafter, the rectangular opening was sufficiently heated at 110° C. for 50 minutes to form both of the decomposing chamber 53, 100×100 μm in size and 20 μm in height, and the nozzle 54, 50 μm in diameter and 20 μm in length.

Figure 6:
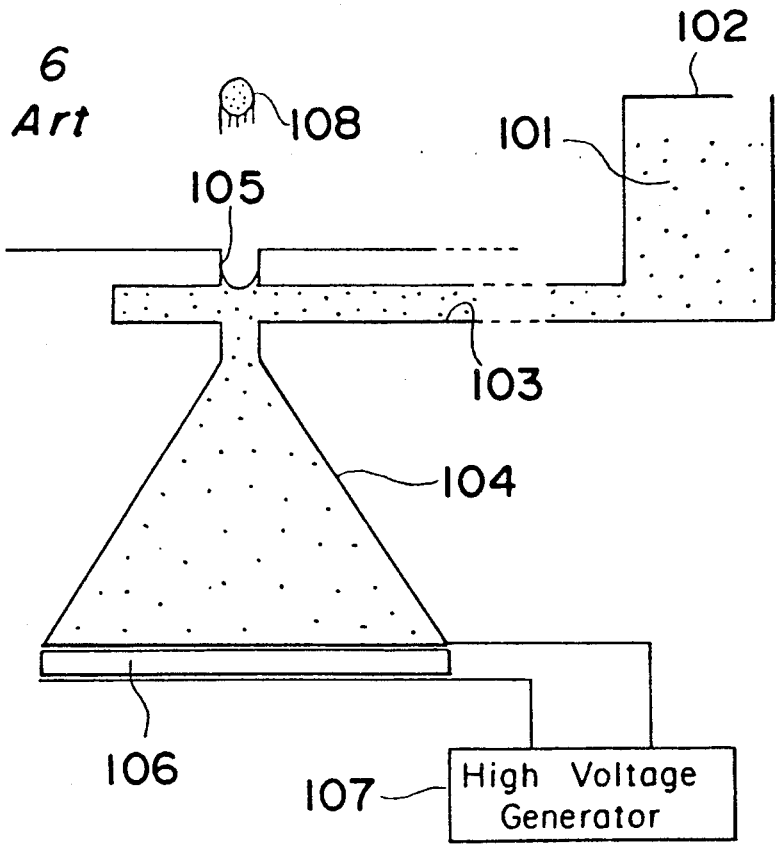
Fig. 6 Prior Art
FIG. 6 is the schematic partial side sectional view of the prior art ink jet recording apparatus.

The inking medium 51*m* used was a commercially available black ink for use with an airbrush made and sold by Holbein Works Ltd., while the liquid electrolyte 51*n* was of a composition containing 20 parts by weighty of water and 5 parts by weight of sodium hydroxide. The inking medium used is of a type capable of exhibiting waterproof characteristics when dried. Thereafter, while the recording apparatus was reduced in pressure with the aid of a vacuum pump, the electrolyte supply passage 56*n* is contacted with the electrolyte 51*n* to fill the recording apparatus with the electrolyte 51*n*. Then, by supplying the linking medium 51*m* from the ink tank 55*m* through the ink supply passage 56*m*, the inking medium was discharged some times to render the recording apparatus to assume such a condition as shown in FIG. 6. Starting from this condition and when the signal generator 57 is driven by a pulse width (500 Hz, Pw30: 0.2 ms, Pw31: 0.1 ms), a black-and-white recording on a high quality paper could be achieved with the electrolyzing signal voltage V30 being 30 volts and with the discharge signal voltage V31 being 100 volts.

According to the third preferred embodiment of the present invention, the polarity of the electrolyzing signal is reversed and, for this reason, the proportion of the mixed gases generated in the vicinity of the electrode 52*a* and that in the vicinity of the electrode 52*b* can advantageously be rendered identical (i.e., H:O=2:1). Accordingly, the discharge explosion occurring in the system can result in a complete transformation into a liquid medium (water) with no gas remaining, thus making the recording apparatus to discharge the inking medium in stabilized fashion.

Although the present invention has been fully described in connection with the preferred embodiments thereof with reference to the accompanying drawings, it is to be noted that various changes and modifications are apparent to those skilled in the art. For example, although in describing the third preferred embodiment with reference to FIG. 1 the liquid electrolyte has been described as supplied from the nozzle room into the electrolyte room through the filtering membrane, arrangement may be made in which a liquid medium prepared so as to contain a large proportion of the liquid electrolyte obtained by filtering the inking medium through a separate filtering membrane (not shown) can be supplied directly into the decomposing chamber through a separate passage, not through the nozzle 54, while the residue of the inking medium from which the electrolyte has been filtered can be supplied to the nozzle 54.

Also, in describing the third preferred embodiment with reference to FIGS. 4 and 5, the use has been made of the gases as a medium operable to transmit a pressure, produced upon the generation of the gases, to the inking medium. However, for the same purpose, the use may be made of a liquid medium insoluble in the liquid electrolyte and the inking medium, or a solid matter having a rubber elasticity. In such case, no electrolyte will be discharged together with the inking medium when the discharge explosion takes place and, therefore, the electrolyte 51*n* need not be supplemented, making it possible to render the recording apparatus to be simple in structure.

In addition, the electrolyzing signal used may comprise voltages of the same or opposite polarities or of different pulse widths. Although in the illustrated embodiment the electrolyzing signal has been described as comprising a single-time inverted signal, it may comprise a combination of inverted signal.

Again, in any one of the second and third embodiments shown in FIGS. 3 and 5, respectively, reference has been made to the application of the discharge signal following the application of the discharge signal. However, the discharge signal may be applied a predetermined time subsequent to the application of the electrolyzing signal provided that the both are generated within the same cycle T2 or T3.

Furthermore, in the practice of the present invention, the signal generator may not be always limited to the design shown and described, but may be of any suitable design provided that the previously discussed signal voltage or voltages can be generated therefrom. Yet, the recording apparatus shown in FIG. 1 can make use of the signal generator shown in and described with reference to any one of the FIGS. 3 and 5 and, in a similar way, some of the component parts, such as, for example, the decomposing chamber and/or the signal generator, which have been described and shown in connection with one preferred embodiment of the present invention can be combined with those which have been described and shown in connection with another preferred embodiment of the present invention.

Accordingly, such changes and modifications are to be understood as included within the scope of the present invention unless they depart therefrom.

What is claimed is:

1. An ink jet recording apparatus comprising:
an inking medium containing a liquid electrolyte;
a chamber having a pair of electrodes disposed therein;
a nozzle communicating from the chamber to the atmosphere through a filtering membrane capable of passing therethrough at least the liquid electrolyte;
an ink supply means for supplying a liquid inking medium to the nozzle and also for supplying at least the liquid electrolyte into the chamber;
wherein the filtering membrane is disposed so as to prohibit the inking medium from contacting the pair of electrodes;
a signal generating means for applying to the pair of the electrodes a signal necessary to electrolyze at least a portion of the liquid electrolyte, thereby causing the liquid inking medium to be discharged from the chamber in response to the signal.

2. The recording apparatus as claimed in claim 1, wherein said signal comprises an electrolyzing signal for electrolyzing the electrolyte and a discharge signal for effecting a discharge explosion of gases produced as a result of the electrolyzing signal.

3. The recording apparatus as claimed in claim 2, wherein the discharge signal is opposite in polarity to the electrolyzing signal.

4. The recording apparatus as claimed in claim 2, wherein the polarity of the electrolyzing signal is inverted at least one time during a predetermined time in which the electrolyzing signal is applied.

5. An ink jet recording apparatus comprising:
an inking medium;
a liquid electrolyte;
a chamber having a pair of electrodes disposed therein;
a nozzle for discharging the inking medium therefrom;
a pressure transmitting medium for transmitting a change in pressure within the chamber to an interior of the nozzle;
an ink supply means for supplying the liquid inking medium to the nozzle;
an electrolyte supply means for supplying the electrolyte into the chamber; and
a signal generating means for applying to the pair of the electrodes a signal comprising an electrolyzing signal necessary to electrolyze at least a portion of the electrolyte and a discharge signal necessary to effect a discharge explosion of gases produced by the electrolyzing signal, thereby causing the inking medium to be discharged from the chamber in response to the electrolyzing and discharge signals.

6. The recording apparatus as claimed in claim 5, wherein said pressure transmitting medium is gases.

7. The recording apparatus as claimed in claim 5, wherein the discharge signal is opposite in polarity to the electrolyzing signal.

8. The recording apparatus as claimed in claim 5, wherein the polarity of the electrolyzing signal is inverted at least one time during a predetermined time in which the electrolyzing signal is applied.

9. An ink jet recording apparatus comprising:
an inking medium containing a liquid electrolyte;
a chamber accommodating therein the liquid inking medium and having a pair of electrodes disposed therein in contact with the inking medium;
an ink supply means for supplying the liquid inking medium into the chamber; and
a signal generating means for applying to the pair of electrodes an electrolyzing signal necessary to electrolyze at least a portion of the electrolyte contained in the inking medium and a discharge signal necessary to effect a discharge explosion of gases produced by an electrolyzing signal, said inking medium within the chamber being discharged from the chamber in response to the application of said electrolyzing and discharge signals to the pair of the electrodes.

10. The recording apparatus as claimed in claim 9, wherein the discharge signal is opposite in polarity to the electrolyzing signal.

11. The recording apparatus as claimed in claim 9, wherein the polarity of the electrolyzing signal is inverted at least one time during a predetermined time in which the electrolyzing signal is applied.

* * * * *